United States Patent [19]

Budner

[11] Patent Number: 4,884,979

[45] Date of Patent: Dec. 5, 1989

[54] EXTENSION CORD CLAMP

[76] Inventor: Henry M. Budner, 1926 Rodman St., Hollywood, Fla. 33020

[21] Appl. No.: 339,016

[22] Filed: Apr. 14, 1989

[51] Int. Cl.[4] ..... H01R 13/58

[52] U.S. Cl. ..... 439/369

[58] Field of Search ..... 439/369, 367

[56] References Cited

U.S. PATENT DOCUMENTS

| | | | |
|---|---|---|---|
| 3,048,810 | 8/1962 | Steen | 439/369 |
| 3,223,958 | 12/1965 | Prohl | 439/369 |
| 3,344,393 | 9/1967 | Hendee | 439/369 |
| 3,609,638 | 9/1971 | Darrey | 439/369 |
| 4,143,934 | 3/1979 | Siebert | 439/369 |
| 4,643,505 | 2/1987 | House et al. | 439/369 |

*Primary Examiner*—Gary F. Paumen

*Attorney, Agent, or Firm*—Herbert L. Lerner; Laurence A. Greenberg

[57] ABSTRACT

An extension cord clamp for reinforcing a connection between two components attached to cords includes a quadralateral or annular frame with a central opening for receiving the components. Two mutually opposite channels are each formed in the frame. The channels are substantially centrally formed in a respective one of the sides if a quadralateral frame is provided. Two pivot pins are fastened to the frame in the vicinity of a respective one of the channels. Tabs are each pivotable about a respective one of the pivot pins into a closed position. The tabs each have an edge facing toward the central opening in the closed position. The edges each have a respective notch formed therein. Two locking pins are each fastened to the frame in the vicinity of a respective one of the channels for engaging a respective one of the notches and locking the tabs to the frame with the cords in the channels and the tabs in the closed position.

11 Claims, 1 Drawing Sheet

EXTENSION CORD CLAMP

BACKGROUND OF THE INVENTION

1. Field of the Invention

The invention relates to an extension cord clamp for reinforcing the connection between an extension cord and a cord from an electric device.

2. Description of the Related Art

The use of extension cords is very common in both household and commercial applications. A common problem is the necessity of having to repeatedly reconnect a lawnmower extension cord, a power-tool extension cord or the like. Possible solutions to this problem range from simply tying a knot in the cords around the connection to elaborately complicated devices, some of which have been disclosed in patents.

Among the many patents disclosing devices for reinforcing the connection between plugs and sockets are U.S. Pat. Nos. 3,048,810 to Steen, 3,223,958 to Prohl, 3,344,393 to Hendee, 3,609,638 to Darrey, 4,143,934 to Siebert and 4,643,505 to House et al.

These and other known devices which relate to reinforcing the connection of extension cord sockets and plugs all have disadvantages and limitations.

Firstly, most of the above patents disclose housings which enclose the plug and socket connection in its entirety. This feature, naturally, limits the shapes and sizes of connectors that may be used with the device. Also, the entire housing will be opened at once, so that both connectors come free at the same time.

One patent which belongs to the above family is 3,223,958 to Prohl. Prohl discloses a sheet metal frame to which a plug-connector pair is clamped by means of two resilient arms. It is obvious that this device is quite limited as to the size and shape of connectors that may be used. Also, if two substantially different sizes of connectors were to be used, this device would be rendered ineffective, since only one of the two connectors would be clamped into the reinforcement.

Secondly, some of the devices disclosed in the above patents apply pressure to the plug and socket and thus put unnecessary strain on the plug-cord or socket-cord connections, which may lead to bad connections and/or to the connections being shorted or disconnected.

Thirdly, some of the above patents disclose devices which are complicated with respect to their construction and thus are complicated to use and can only be manufactured at relatively high cost.

Fourthly, while some of the above patents feature full enclosure housings for the plug-socket connection, others leave the connection prone to external shock influences. A patent belonging to the latter family is 3,609,638 to Darrey. It is conceivable that when the clamping device in accordance with the Darrey patent falls on the ground, one or both of the butterfly clamps may open momentarily and release the extension cord. Also, the device is likely to open and release the cord if it is stepped upon.

SUMMARY OF THE INVENTION

It is accordingly an object of the invention to provide an extension cord clamp which overcomes the hereinaforementioned disadvantages of the heretofore-known devices of this general type and which securely reinforces the connection between a plug and a socket of an extension cord without applying undue force on the connection between the cords and the plug and socket, respectively, and which protects the plug-socket connection from external forces without hindering free access to the connection.

With the foregoing and other objects in view there is provided, in accordance with the invention, an extension cord clamp for reinforcing a connection between two components attached to cords, comprising a frame including sides and a central opening for receiving the components, two mutually opposite channels or grooves each being formed substantially centrally in a respective one of the sides, two pivot pins each being fastened to a respective one of the sides of the frame in the vicinity of a respective one of the channels, tabs each being pivotable about a respective one of the pivot pins into a closed position, the tabs each having an edge facing toward the central opening in the closed position, each edge having a respective notch formed therein, and two locking pins each being fastened to a respective one of the sides of the frame in the vicinity of a respective one of the grooves for engaging a respective one of the notches and locking the tabs to the frame with the cords in the grooves and the tabs in the closed position.

In accordance with another feature of the invention, the frame has a substantially rectangular shape, with two of the sides being relatively shorter and two of the sides being relatively longer, and each of one of the channels being disposed substantially centrally in a respective one of the shorter sides.

In accordance with a further feature of the invention, the frame has a substantially rectangular shape, with two of the sides being relatively shorter and two of the sides being relatively longer, and each of the channels being disposed substantially centrally in a respective one of the longer sides.

In accordance with an added feature of the invention, the frame is formed of a non-conducting material.

In accordance with an additional feature of the invention, the frame is formed of a one-piece molded plastic.

In accordance with again another feature of the invention, the frame is formed of four pieces attached to each other.

In accordance with again a further feature of the invention, each of the channels is in the form of means for receiving enough of a cross section of a respective cord to hold the cord in place in cooperation with one of the tabs.

In accordance with a concomitant feature of the invention, the pivot pins have heads, and there are provided two coil springs each being disposed between a respective head of one of the pivot pins and a respective one of the tabs, for forcing the tabs in a direction toward the frame.

With the tabs in the "closed" position an extension cord is held in a groove or channel in the frame portion with a plug extending into a free space in the central portion of the frame. On the opposite side within the central portion of the frame a cord is locked into a groove by a tab.

The frame in accordance with the invention, which is formed of a rigid material, has an central opening which is large enough to accommodate various sizes and shapes of plugs and sockets.

It is a specially advantageous feature of the invention that only one cord at a time may be removed from the device as desired; it is, therefore, possible to leave the extension cord clamp attached to the extension cord for storage.

Other features which are considered as characteristic for the invention are set forth in the appended claims.

Although the invention is illustrated and described herein as embodied in an extension cord clamp, it is nevertheless not intended to be limited to the details shown, since various modifications and structural changes may be made therein without departing from the spirit of the invention and within the scope and range of equivalents of the claims. The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
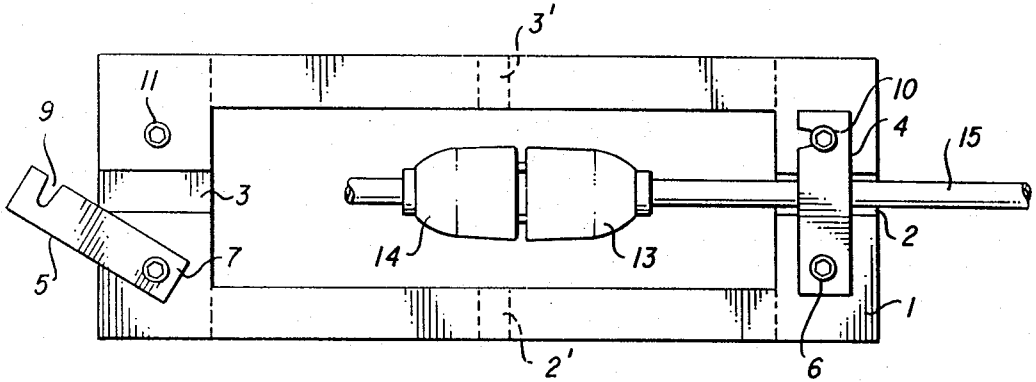
FIG. 1 is a fragmentary, diagrammatic, top-plan view of the extension cord clamp according to the invention.

Referring now to the figures of the drawing in detail and first, particularly, to FIG. 1 thereof, there is seen an extension cord clamp with a substantially rectangular frame 1 which is formed from plastic or other, preferably nonconducting, material. The frame 1 may be formed of one piece or several pieces glued together as shown in phantom in FIG. 1. Grooves or channels 2 and 3 are centrally disposed in the short sides of the rectangular frame 1, or grooves or channels 21 and 31 are disposed in the long sides of frame 1 as shown in phantom in FIG. 1. Tabs 4 and 5 are pivotably attached to the frame 1. FIG. 1 shows the tab 4 in a "closed" position, with a cord 15 inserted in the groove 2. The tab 5 is depicted in an "open" position, i.e. it has been pivoted in a counter-clockwise direction in order to make room for a second, non-illustrated cord to be inserted into the groove 3.

After the non-illustrated cord is inserted into the groove 3, the tab 5 may be pivotted about a pivot pin 7 in order to clamp down the cord in the groove 3. The tab 5 features a notch 9 which makes it possible for the tab 5 to be held in place by a locking screw 11 which engages in the notch 9.

The tab 4, shown in the closed position, is locked in place by a locking screw 10, which matches a notch 8 in the edge of the tab 4. The locking screws 100 and all shown are so-called thumb screws which are fitted with screw-heads which are ribbed on the circumferential surface for manual operation, and a slot or cross-slot for screwdriver operation. The locking screws 10 and 11 may, naturally, also have wing-heads for exclusively manual operation.

Also illustrated in FIG. 1 is a central opening 12 in the frame 1, within which a receptacle 13 and a plug 14 are connected. The opening 12 is large enough to hold various sizes and shapes of connectors: in particular, the respective sizes and shapes of the plug 14 and the receptacle 13 may be very different. Also, the connectors are easily accessible without altering the positions of the tabs 4 and 5.

Figure 2:
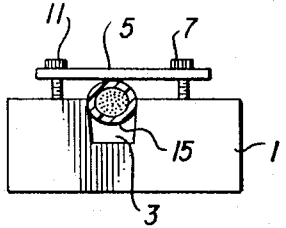
FIG. 2 is a side-elevational view of the extension cord clamp.

As shown in FIG. 2, the tabs 4 and 5 are held in place by means of the pivot pins 6 and 7. Coil springs 16 and 17 push the respective tabs 4 and 5 respectively towards the frame 1, thus locking the cord 15 in the grooves 2 and 3. The force excerted on the tabs 4 and 5 by the respective pivot pins 6 and 7 respectively may be adjusted by either tightening or loosening the pivot pins 6 and 7 or by choosing coil springs 16 and 17 with different spring constants; in other words, springs with different spring constants may be used for different applications, while in less than extreme conditions there will not be a need to exchange the coil springs.

Figure 3:
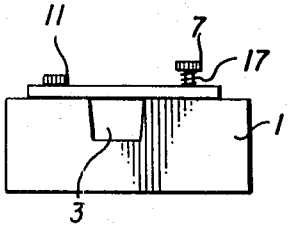
FIG. 3 is an end-elevational view of the extension cord clamp without the cord.

FIG. 3 shows the end surface of the frame 1 with the tab 5 locked in place by the pivot pin 7 with the coil spring 17 and the locking screw 11. Since no cord is located in the groove 3, the tab touches the frame 1, with the coil spring 17 fully extended.

Figure 4:
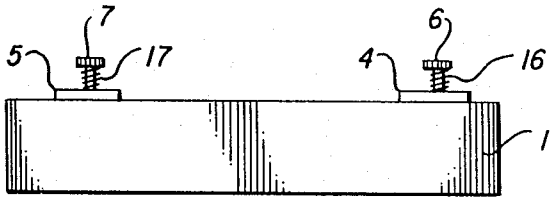
FIG. 4 is an end-elevational view of the extension cord clamp with a cord in place.

FIG. 4 shows the same end surface as FIG. 3, but with the cord 15 placed in the groove 3. The coil spring 17 is compressed as shown, thus applying a downward force on the tab 5. This downward force together with the force applied on the tab 5 by the locking screw 11 forces the cord 15 into the groove 3. The slight deformation of the cord 15, as illustrated in FIG. 4, adds to the firmness with which the cord is then held in place.

Figure 5:
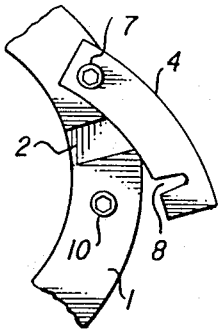
FIG. 5 is a fragmentary top-plan view of a second embodiment of the extension cord clamp.

FIG. 5 is a fragmentary view of a second embodiment, in which the frame of the extension cord clamp has a circular or elliptical shape. As shown in FIG. 5, the tab 4, and accordingly the non-illustrated tab 5 as well, are adapted to the respective curved shape of the frame.

I claim:

1. An extension cord clamp for reinforcing a connection between two components attached to cords, comprising:

(a) a frame including sides and a central opening for receiving the components;

(b) two mutually opposite channels each being formed substantially centrally in a respective one of said sides;

(c) two pivot pins each being fastened to a respective one of said sides of said frame in the vicinity of a respective one of said channels, two tabs each being pivotable about a respective one of said pivot pins into a closed position, said tabs each having an edge facing toward said central opening in said closed position, said edges each having a respective notch formed therein; and (d) two locking pins each being fastened to a respective one of said sides of said frame in the vicinity of a respective one of said channels for engaging a respective one of said notches and locking said tabs to said frame with the cords in said channels and said tabs in said closed position, said tabs adapted to be biased against the cords to retain the cords in said channels.

2. The extension cord clamp according to claim 1, wherein said frame has a substantially rectangular shape, two of said sides being relatively shorter and two of said sides being relatively longer, and each of said channels being disposed substantially centrally in a respective one of said shorter sides.

3. The extension cord clamp according to claim 1, wherein said frame has a substantially rectangular shape, two of said sides being relatively shorter and two of said sides being relatively longer, and each of said channels being disposed substantially centrally in a respective one of said longer sides.

4. The extension cord clamp according to claim 1, wherein said frame is formed of a non-conducting material.

5. The extension cord clamp according to claim 1, wherein said frame is formed of a one-piece molded plastic.

6. The extension cord clamp according to claim 1, wherein said frame is formed of four pieces attached to each other.

7. The extension cord clamp according to claim 1, wherein each of said channels is in the form of means for receiving enough of a cross section of a respective cord to hold the cord in place in cooperation with one of said tabs.

8. The extension cord clamp according to claim 1, wherein said pivot pins have heads, and including two coil springs each being disposed between said head of a respective one of said pivot pins and a respective one of said tabs, for forcing said tabs in a direction toward said frame.

9. An extension cord clamp for reinforcing a connection between two components attached to cords, comprising an annular frame with a central opening, two mutually opposite channels formed in said frame, two pivot pins each being fastened to said frame in the vicinity of a respective one of said channels, tabs each being pivotable about a respective one of said pivot pins into a closed position, said tabs each having an edge facing toward said central opening in said closed position, said edges each having a respective notch formed therein, and two locking pins each being fastened to said frame in the vicinity of a respective one of said channels for engaging a respective one of said notches and locking said tabs to said frame with the cords in said channels and said tabs in said closed position, said tabs adapted to be biased against the cords to retain the cords in said channels.

10. The extension cord clamp according to claim 9, wherein said tabs are curved to match the curvature of said frame.

11. The extension cord clamp accordimg to claim 9, wherein said pivot have heads, and including two coil springs each being disposed between said head of a respective one of said pivot pins and a respective one of said tabs, for forcing said tabs in a direction toward said frame.

* * * * *